US008199005B2

(12) United States Patent
Thomas et al.

(10) Patent No.: US 8,199,005 B2
(45) Date of Patent: Jun. 12, 2012

(54) SYSTEM AND METHODS FOR USING A WIRELESS SENSOR IN CONJUNCTION WITH A HOST CONTROLLER

(75) Inventors: Robert J. Thomas, Brier, WA (US); William J. Bray, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 379 days.

(21) Appl. No.: 11/935,941

(22) Filed: Nov. 6, 2007

(65) Prior Publication Data

US 2009/0115604 A1 May 7, 2009

(51) Int. Cl.

| | |
|---|---|
| ***G08B 21/00*** | (2006.01) |
| ***G08B 17/00*** | (2006.01) |
| ***G08B 1/08*** | (2006.01) |
| ***G05B 13/00*** | (2006.01) |
| ***G05B 15/00*** | (2006.01) |
| ***F24F 7/00*** | (2006.01) |

(52) U.S. Cl. ..... 340/540; 340/584; 340/539.27; 700/276; 700/277; 236/49.3

(58) Field of Classification Search ..... 340/539.27, 340/540

See application file for complete search history.

(56) References Cited

U.S. PATENT DOCUMENTS

| | | | | |
|---|---|---|---|---|
| 5,348,078 | A | 9/1994 | Dushane et al. | |
| 5,481,481 | A * | 1/1996 | Frey et al. | 702/82 |
| 5,927,599 | A * | 7/1999 | Kath | 236/47 |
| 6,116,512 | A | 9/2000 | Dushane et al. | |
| 6,213,404 | B1 | 4/2001 | Dushane et al. | |
| 6,513,723 | B1 | 2/2003 | Mueller et al. | |
| 6,672,076 | B2 * | 1/2004 | Bell | 62/3.3 |
| 6,902,117 | B1 | 6/2005 | Rosen | |
| 7,050,887 | B2 * | 5/2006 | Alvarez | 700/284 |
| 7,565,225 | B2 * | 7/2009 | Dushane et al. | 700/276 |
| 2006/0097063 | A1 * | 5/2006 | Zeevi | 236/49.3 |

OTHER PUBLICATIONS http://webarchive.org/web20061019145123/www.bapihvac.com . . . , "BAPI Wireless Analog Output Modules," 2 pages, Copyright 2006, screen shots taken Sep. 17, 2010.

http://www.bapihvac.com/Wireless_Output_Modules.htm, "Wireless Analog Output Modules," 2 pages, Copyright 2007, screen shots taken Sep. 17, 2010.

Trane, "High Performance Buildings," 12 pages, prior to Jul. 14, 2010.

Trane, "Installation, Operation and Maintenance, Wireless Sensors Models WTS, WZS, and WDS," 52 pages, Apr. 2008.

Trane, "Marketing Guide, Wireless Sensors Models WTS and WZS," 18 pages, Jan. 2007.

Trane, "Product Catalog, Wireless Sensors Models WTS and WZS," 8 pages, Mar. 2008.

Trane, "Wireless Zone Sensor. Where Will Technology Take You,?" 4 pages, Feb. 2006.

* cited by examiner

*Primary Examiner* — Brent Swarthout
*Assistant Examiner* — John Mortell
(74) *Attorney, Agent, or Firm* — Seager Tufte & Wickhem LLC

(57) ABSTRACT

Systems and methods for using a wireless sensor in conjunction with a host controller are described. An illustrative system can include a host controller, a wireless sensor device, and a decoder in communication with the wireless sensor device and the host controller. The host controller may include a remote sensor input that normally would be connected to a wired remote sensor having an expected sensor characteristic. The decoder may receive a wireless signal from the wireless sensor device, and may provide an output signal to the remote sensor input of the host controller that replicate or mimic signals that would be provided by a wired remote sensor having the expected sensor characteristic.

20 Claims, 7 Drawing Sheets

SYSTEM AND METHODS FOR USING A WIRELESS SENSOR IN CONJUNCTION WITH A HOST CONTROLLER

FIELD

The present disclosure relates generally to the field of remote sensors and controllers. More specifically, the present disclosure relates to systems and methods for using one or more wireless sensors in conjunction with a host controller such as an HVAC controller.

BACKGROUND

Remote sensors are utilized in a variety of applications for measuring parameters such as air temperature, relative humidity, carbon monoxide levels, and motion occurring within a home or other building. In HVAC systems, such remote sensors may be used to sense the air temperature at various locations within the building. For example, many hotel rooms have a remote sensor wall unit. The remote sensor wall unit typically has a temperature sensor to sense the temperature in the hotel room. A HVAC controller, typically located remote from the remote sensor wall unit, typically receives signals from the remote sensor wall unit and controls a fan coil unit, a roof top unit, a damper, or other HVAC component accordingly. Likewise, remote sensors are often employed to permit an HVAC controller to sense and control the temperature in multiple zones within a home or other building.

The connection of a remote sensor to an HVAC controller often requires the installation of wires between the remote sensor(s) and the HVAC controller. This can increase the cost of installation, and in many cases such as in some retrofit applications, may not even be practical. While the use of wireless sensors has gained in popularity, such systems typically require that the HVAC controller itself include a wireless transceiver for receiving the wireless signals from the wireless remote sensors. The HVAC controller then processes the received wireless signals to read the sensed parameter value therefrom. This can increase the cost of many systems, especially in retrofit situations.

SUMMARY

The present disclosure relates to systems and methods for using one or more wireless sensors in conjunction with a controller such as an HVAC controller that has one or more remote sensor input(s). A remote sensor input, which can include one or more separate terminals, may be configured to be connected to a wired remote sensor having certain predetermined sensor characteristics. For example, a remote sensor input of an HVAC controller may be configured to be wired to a 10K ohm thermistor, a 20K ohm thermistor, a 30K ohm thermistor, or some other sensor having an expected impedance or impedance range. Alternatively, or in addition, a remote sensor input may be configured to be wired to an analog current signal (e.g. 4-20 mA), an analog voltage signal, or a signal having a certain frequency characteristic or the like provided by a wired remote sensor.

A wireless sensor with a wireless transmitter may be provided for sensing one or more environmental parameters remote from an HVAC controller. A decoder, with a wireless receiver, may be connected to a remote sensor input of an HVAC controller. During use, the wireless sensor may transmit a wireless signal that encodes or otherwise represents the sensed environmental parameter(s). The decoder may receive the wireless signal transmitted by the wireless sensor. The decoder may then convert the received wireless signal into a signal that is compatible with the expected sensor characteristics of the corresponding remote sensor input of the HVAC controller. From the point of the view of the HVAC controller, the wireless sensor and decoder may collectively provide a signal that mimics an output of expected wired remote sensor, and may present data to the HVAC controller as if the data had come directly from a wired remote sensor.

It is contemplated that in some cases, the decoder may have selectable output characteristics so that the wireless sensor and decoder can be used in conjunction with a variety of remote sensor inputs. For example, the output of the decoder may be selectable to provide a signal that mimics a 10K ohm thermistor, a 20K ohm thermistor, a 30K ohm thermistor, or some other expected impedance or impedance range of a wired remote sensor. Alternatively, or in addition, the output of the decoder may be selectable to provide a signal that mimics an analog current signal (e.g. 4-20 mA), an analog voltage signal, or a signal having a certain frequency characteristic or the like of a wired remote sensor. In some cases, the wireless sensor and decoder can be used to provide a wireless sensor solution for many convention HVAC controllers that have a remote sensor input that is conventionally wired to a remote sensor.

DETAILED DESCRIPTION

The following description should be read with reference to the drawings, in which like elements in different drawings are numbered in like fashion. The drawings, which are not necessarily to scale, depict illustrative embodiments and are not intended to limit the scope of the disclosure. Although several examples are illustrated in the various views, those skilled in the art will recognize that many of the examples provided have suitable alternatives that can be utilized. Moreover, while the various devices, systems and methods herein are generally described for use in HVAC systems, it should be understood that the present invention can be employed in other applications involving the connection of wireless sensors to controllers. Such applications may include, but are not limited to, industrial, manufacturing and other applications, as desired.

Figure 1:
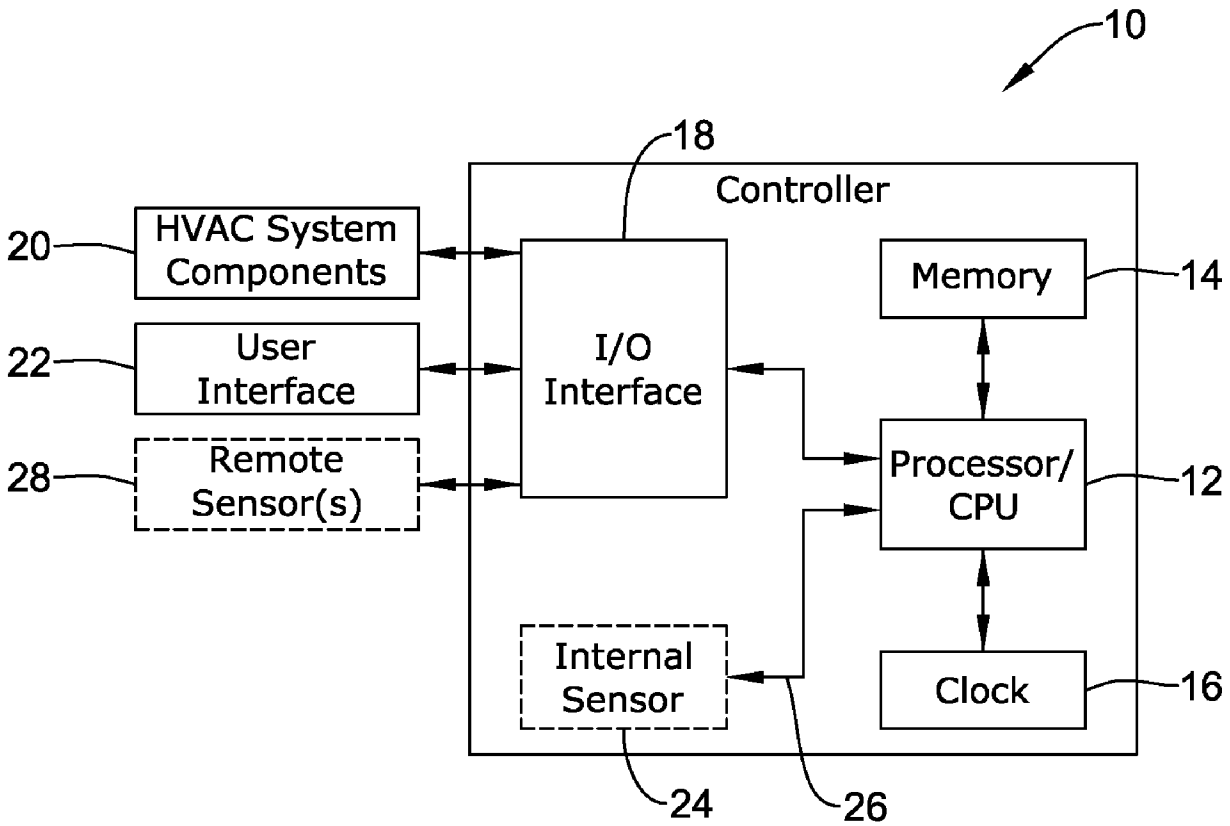
FIG. 1 is a diagrammatic view of an illustrative HVAC controller.

Referring now to FIG. 1, a diagrammatic view of an illustrative controller 10 will now be described. The controller 10, illustratively an HVAC controller for use in controlling an HVAC system, can include a processor 12 (e.g. a microcontroller, microprocessor and/or CPU), a storage memory 14, a clock 16, and an I/O interface 18 that can be used to electrically connect the controller 10 to one or more other HVAC system components 20. In an illustrative HVAC system for use in an office building, for example, the controller 10 can be electrically connected to an air conditioner unit, a heater unit, and/or a humidifier/dehumidifier unit that can be used to regulate the temperature and humidity levels within the building. Other components such as a filtration unit, UV lamp, defroster, and/or one or more dampers may also be connected to the controller 10, as desired. These are only illustrative components, and it is contemplated that the controller 10 may be connected to any suitable component or components, depending on the application.

In some cases, a user interface 22 can be included to provide signals to and from the HVAC controller 10. The user interface 22 can include a number of buttons, a touch screen, an LCD panel and keypad, a computer (e.g. a PDA), and/or any other suitable device for sending and receiving information to and from the controller 10. In certain embodiments, the user interface 22 may include a menu-driven interface that allows the user to navigate through one or more menus or screens to view and, if desired, modify various operational settings and parameters of the HVAC controller 10.

In some cases, the HVAC controller 10 may have an internal sensor 24 located within the controller housing for sensing the temperature and/or humidity levels at the location of the controller 10, but this is not required. The inclusion of such an internal sensor 24 is optional. When provided, the internal sensor 24 may include, for example, a thermistor, thermocouple, or any other suitable sensor or sensor type for locally sensing temperature at or near the HVAC controller 10. Other types of internal sensors such as humidity sensors, carbon monoxide sensors, carbon dioxide sensors, fire sensors, motion sensors, and/or occupancy sensors may be provided, depending on the type of controller 10.

Many conventional HVAC controllers are equipped with one or more remote sensor inputs, each of which may include one or more terminals. Conventionally, and during use of such HVAC controllers, a remote sensor 28 may be wired to each or selected ones of the remote sensor inputs of the HVAC controller 10. Typically, the remote sensors 28 will present a current, resistance, voltage, frequency and/or other sensor characteristics to the processor 12 via I/O interface 18. The particular current, resistance, voltage, frequency and/or other sensor characteristic may represents a sensed parameter, such as the ambient air temperature or other sensed parameter at or near the remote location of the remote sensor 28. The connection of such wired remote sensors 28 typically require the installation of wires extending between the wired remote sensor(s) 28 and the HVAC controller 10. This can increase the cost of installation, and in many cases, may not even be practical such as in some retrofit applications.

Figure 2:
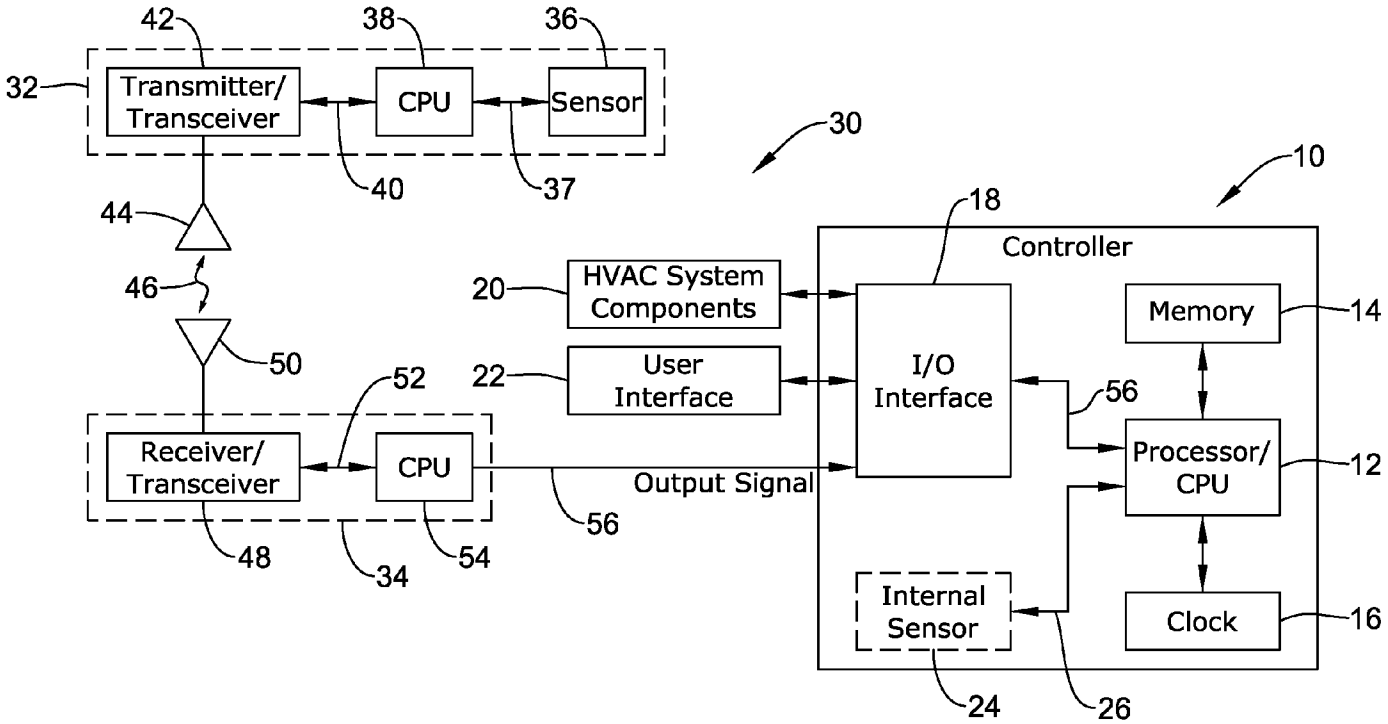
FIG. 2 is a diagrammatic view of an illustrative system that uses one or more wireless remote sensors in conjunction with a controller.

FIG. 2 is a diagrammatic view showing an illustrative system 30 that uses one or more wireless remote sensors. As shown in FIG. 2, the system 30 can include a wireless sensor 32 that is in wireless communication with a decoder 34. In certain embodiments, for example, a wireless remote sensor 32 may be a wall-mounted sensor that is to be wirelessly connected to the controller 10 for use in sensing parameters such as air temperature and/or humidity at a location remote from the controller 10. In some embodiments, the wireless remote sensor 32 and decoder 34 may be a pair of wireless units that can be provided as part of an expansion or add-on kit for use with the controller 10. The decoder 34 can be connected to the I/O interface 18 of the controller 10, and can be configured to provide signals to the controller 10 that mimic the signals 26 that would otherwise be provided by a conventional wired sensor.

In the illustrative embodiment, the wireless sensor 32 includes a sensor 36 adapted to sense or measure one or more environmental parameters. The sensor 36 can be configured to output a sensor output signal 37 to a processor 38 or other circuit, which then converts or encodes the sensor output signal 37 into a wireless signal 40 for transmission to the decoder 34 via a wireless transmitter 42. In some cases, the wireless transmitter 42 may be a wireless transceiver and may be capable of both transmitting and receiving signals to/from the decoder 34. Example signals that might be sent to the wireless sensor 32 may include, but are not limited to, battery status requests, wakeup from sleep state requests, go to sleep state requests, calibration information, acknowledge messages, and/or any other suitable signal, request or message, depending on the application.

In some cases, the processor 38 of the wireless sensor 32 can include, for example, an A/D converter that converts an analog sensor output signal 37 into a digital signal 40. In other embodiments, the sensor 36 may be connected to a circuit that replaces or supplements the processor 38, and which converts or helps convert the signal 37 into a digital or other form. In some embodiments, the processor 38 and/or circuit may produce an output that has a frequency that is representative of the sensed parameter.

The signal 40 output by the processor 38 (and/or other circuit) can be fed to a wireless transmitter 42 having an antenna 44. In some cases, and as noted above, the transmitter 42 may be part of a transceiver. The wireless transmitter may transmit a wireless signal 46, such as an RF signal. The wireless signal 46 can then be received by the decoder 34. In some embodiments, the transmitter 42 can be configured to transmit an RF signal 46 using a radio communications protocol such as BLUETOOTH (i.e. IEEE 802.15.1 standard), ZIGBEE (IEEE 802.15.4 standard), WiFi (i.e. IEEE 802.11 standard), a proprietary communications protocol, or any other suitable protocol, as desired. The wireless signal 46 may contain other data in addition to the sensed parameter information, such as channel identification information uniquely identifying the wireless sensor 32, power status information indicating the power status of the wireless sensor 32, and or any other suitable information, as desired.

Other climate control information such as temperature setpoints may also be transmitted as part of the wireless signal 46. In some embodiments, for example, the wireless sensor 32 may be equipped with a keypad and LCD display allowing the user to adjust the temperature remotely using the wireless sensor 32. The temperature setpoints selected by the user may be transmitted along with the sensed parameter information and/or channel identification information to the decoder 34, if desired.

The decoder 34 can include a receiver 48 and antenna 50 adapted to receive the wireless signals 46 transmitted by the wireless sensor 32. In some cases, the receiver 48 of the decoder 34 may be part of a transceiver, and may be capable of also transmitting signals to the wireless sensor 32. Example signals that might be transmitted to the wireless sensor 32 may include, but are not limited to, battery status requests, wakeup from sleep state requests, go to sleep state requests, calibration information, acknowledge messages, and/or any other suitable signal, request or message, depending on the application.

When both the wireless sensor 32 and the decoder 34 include a transceiver, the wireless sensor 32 and decoder 34 can be configured to communicate in a bi-directional manner, allowing information to be transmitted between the decoder 34 to the wireless sensor 32. For example, the decoder 34 may be configured to transmit signals back to the wireless sensor 32 indicating whether the controller 10 is currently in a heating mode or cooling mode as well as the temperature setpoint for that mode. In some cases, this signal can then be viewed by the user at the wireless sensor 32 and used to adjust the temperature setpoint for the current mode, if desired. The adjustment made by the user can then be transmitted back to the decoder 34, and passed onto the controller 10.

A processor 54 (and/or other suitable circuit) within the decoder 34 can be configured to receive signal 52 from the receiver 48 of the decoder 34, and convert the signals 52 into an appropriate signal that is compatible with the expected sensor characteristics of a corresponding remote sensor input of the I/O interface 18 of the controller 10. When so provided, and from the point of the view of the controller 10, the wireless sensor 32 and decoder 34 may collectively mimic an expected wired remote sensor, and may present data to the HVAC controller 10 as if the data had come directly from a conventional wired remote sensor. In some cases, the CPU 54 of the decoder 34 may include a D/A converter. The D/A converter may produce an analog output signal 56 that mimics the output of a conventional wires sensor at the sensed value. This output signal 56 can then be fed to the I/O interface 18 of the controller 10.

It is contemplated that in some cases, the decoder 34 may have selectable output characteristics so that the wireless sensor 32 and decoder 34 can be used in conjunction with a variety of remote sensor input types of various controllers 10. For example, the output 56 of the decoder 34 may be selectable to mimics either a 10K ohm thermistor, a 20K ohm thermistor, a 30K ohm thermistor, or some other expected impedance or impedance range. Alternatively, or in addition, the output 56 of the decoder 34 may be selectable to mimic an analog current signal (e.g. 4-20 mA), an analog voltage signal, or a signal having a certain frequency characteristic or the like that might be expected by the particular remote sensor input of the controller 10. In some cases, the wireless sensor 32 and decoder 34 can be used to provide a wireless sensor solution for a convention HVAC controller that has a remote sensor input that is designed to be wired to a conventional wired remote sensor.

Although the various components of the illustrative wireless device 32 including the sensor 36, processor 38, and transmitter (or transceiver) 42 can be contained within a single device, as depicted generally by the dashed lines in FIG. 2, it should be understood that one or more of the components may be provided as a separate device, or may be incorporated into another device. In one alternative embodiment, for example, the processor 38 and transmitter (or transceiver) 42 can be provided as a separate device that can be connected to an existing remote sensor (e.g. a humidity sensor) mounted on a wall. Further, the functionality of the CPU and other components may be shared by a CPU having other purposes in a particular product design.

Figure 3:
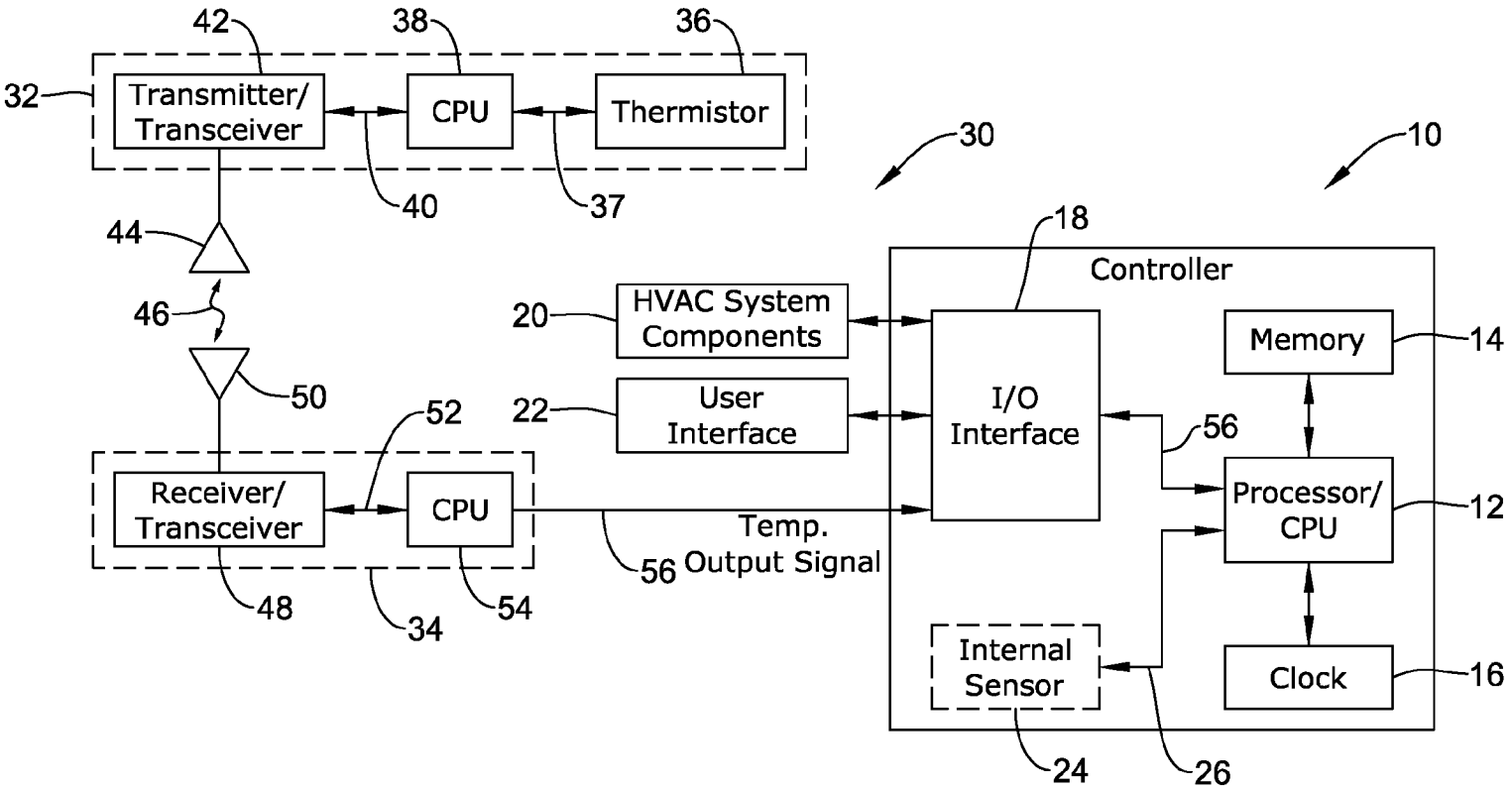
FIG. 3 is a diagrammatic view of an illustrative implementation of the system of FIG. 2 for use in remote temperature sensing.

FIG. 3 is a diagrammatic view showing an illustrative implementation of the system 30 of FIG. 2 for use in remote temperature sensing. As shown in FIG. 3, the wireless sensor 32 may include a temperature sensor equipped with a thermistor 36 that can be used to sense the air temperature at the location of the wireless sensor 32. In some embodiments, for example, the temperature sensor may include a PTC (Positive Temperature Coefficient)-type thermistor or an NTC (Negative Temperature Coefficient)-type thermistor. Other sensors for sensing temperature such as thermocouples or resistance temperature detectors (RTD) may be utilized, if desired.

During operation, the thermistor 36 can output an analog current, resistance or voltage signal 37 based on the particular temperature coefficient of the thermistor 36. For example, and in some cases, the processor 38 or some other circuit of the wireless sensor 32 may provide a known current to the thermistor 36, and the resulting voltage across the thermistor 36 may be provided as analog voltage signal 37 that is representative of the sensed temperature. Alternatively, the processor 38 or some other circuit of the wireless sensor 32 may provide a known voltage to the thermistor 36, and the resulting current through the thermistor 36 may be provided as analog current signal 37 representative of the sensed temperature. In either case, the processor 38 may converts the analog signal 37 into a signal 40 that is representative of the sensed temperature value, and the transmitter (or transceiver) 42 may wirelessly transmit a corresponding wireless signal 46 to the receiver (or transceiver) 48 of the decoder 34.

The wireless signal 46 received by the receiver (or transceiver) 48 of the decoder 34 can be converted to a signal 52, which is fed to the processor 54 of the decoder 34. The processor 54 may be programmed to provide an analog signal 56, or may present a resistance, to the I/O interface 18 of the controller 10 that replicates or mimics the analog signal 37 or resistance produced by, for example, the thermistor 36 or some other thermistor that might normally be wired to a remote sensor input of the I/O interface 18 of the controller 10. In some embodiments, for example, the processor 54 can be configured to convert the signal 52 into an analog format that mimics or replicates a 10 kΩ thermistor, assuming the remote sensor input of the I/O interface 18 of the controller 10 is configured to expect a 10 kΩ thermistor.

It is contemplated that in some cases, the decoder 34 may have selectable output characteristics so that the wireless sensor 32 and decoder 34 can be used in conjunction with a variety of remote sensor input types. For example, the format of output 56 of the decoder 34 may be selectable to mimics a 10K ohm thermistor, a 20K ohm thermistor, a 30K ohm thermistor, or some other expected impedance or impedance range. Alternatively, or in addition, the format of output 56 of the decoder 34 may be selectable to mimic an analog current signal (e.g. 4-20 mA), an analog voltage signal, or a signal having a certain frequency characteristic or the like that might be expected by the particular remote sensor input of the I/O interface 18 of the controller 10.

Figure 4:
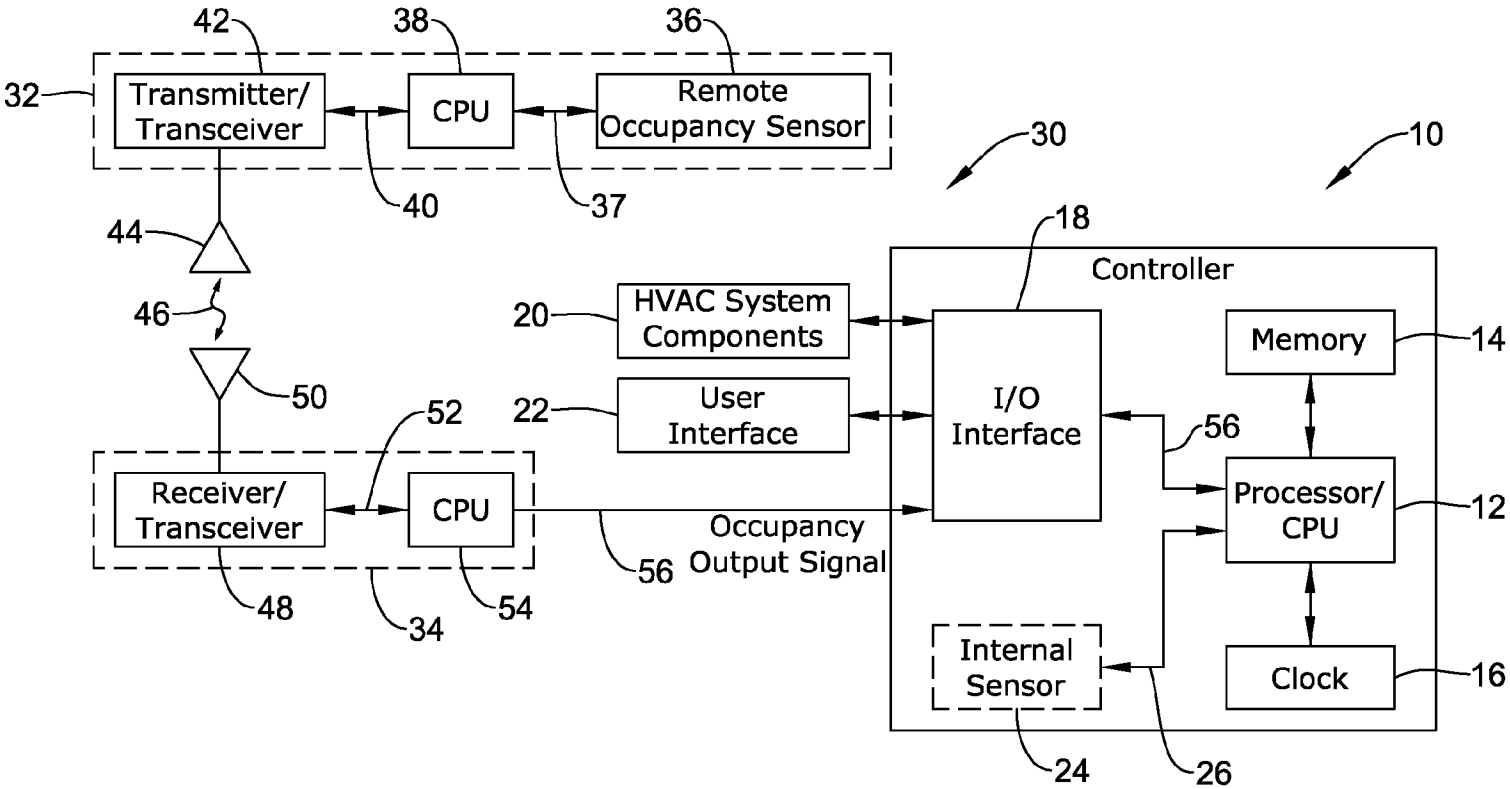
FIG. 4 is a diagrammatic view of an illustrative implementation of the system of FIG. 2 for use in remote occupancy sensing.

FIG. 4 is a diagrammatic view showing an illustrative implementation of the system 30 of FIG. 2 for use in remote occupancy sensing. As shown in FIG. 4, the wireless sensor 32 may include an occupancy sensor 36 that can be used by the controller 10 to detect the presence of motion within a room, building, hallway, parking lot, or at some other desired location. The wireless sensor 32 may include, for example, a motion detector 36 capable of optically or acoustically detecting the presence of motion within a field of view. An example of such a motion detector 36 is an infrared motion detector that detects the presence of heat, or an ultrasonic motion detector that detects the reflection of acoustical waves off a moving object. Other types of motion detectors such as microwave sensors or heat detectors can also be employed.

The wireless sensor 32 can be configured to output a signal in response to an event such as the detection of motion, which can then be converted by the processor 38, and transmitted by the transmitter (or transceiver) 42 to the receiver (or transceiver) 48 of the decoder 34. The decoder 34 can then pass the received signal onto the processor 54, which may convert the signals 52 into an output signal 56 that is compatible with a remote sensor input of the controller 10. In some embodiments, for example, the processor 54 can be configured to output an analog signal 56 to the controller 10 that mimics or replicates an analog signal that might normally be produced by a wired remote occupancy sensor. For example, the processor 54 can be configured to output a 4-20 mA signal to the controller 10 depending on whether motion is detected by the wireless sensor 32. Alternatively, and in other embodiments, the processor 54 can be configured to output a digital signal to the controller 10 (e.g. active high or low) that can be used in conjunction with, or in lieu of, a digital signal that might normally be fed to the controller 10 from a wired-in occupancy sensor.

Other types of remote sensors 36 may be connected to the controller 10 in a similar manner for sensing other types of parameters, if desired. Examples of other types of remote sensors 36 may include, but are not limited to, humidity sensors, carbon monoxide sensors, fire sensors, carbon dioxide sensors, radon detectors, pressure sensors, light detectors, door sensors, proximity sensors, window sensors, switches, and/or motion sensing devices such as accelerometers or gyroscopes.

Although the illustrative systems in FIGS. 2-4 depict the connection of a single wireless sensor 32 to the controller 10, it should be understood that multiple such devices may be connected to the controller 10. In one illustrative system 58 depicted in FIG. 5, for example, multiple wireless sensors 32*a*,32*b*, sometimes each having an associated decoder 34*a*, 34*b*, may be connected to the controller 10 for use in sensing multiple parameters at a single remote location and/or multiple parameters at different remote locations. In one example, a first wireless sensor 32*a* of the system 58 may include, for example, a wireless temperature sensor, whereas a second wireless sensor 32*b* may include an occupancy and/or motion sensor. The analog signals 56*a*,56*b* outputted by each of the decoders 34*a*,34*b* can be connected to different remote sensor inputs of I/O interface 18 of the controller 10, and each may be configured to replicate the signals that would normally be produced by corresponding wired-in sensors.

For example, a decoder 34*a* in communication with a wireless temperature sensor 32*a* may be configured to output an analog signal 56*a* that replicates the output from a wired thermistor that might normally be wired to a corresponding remote sensor input of controller 10. The second decoder 34*b*, in turn, may be configured to output a high or low current signal 56*b* to a corresponding remote sensor input of controller 10, based on whether motion is detected by a remote occupancy or motion sensor 32*b*. Any interference between the wireless signals 46*a*,46*b* transmitted by each wireless device 32*a*,32*b* can be reduced or eliminated by sending the signals 46*a*,46*b* at discrete time intervals and/or by assigning different frequencies or bands to each wireless device 32*a*, 32*b*. In some cases, identification of each wireless device 32*a*,32*b* can be accomplished by, for example, the assignment of a unique identification code by each processor 38, which can be sent along with the sensed information to the corresponding decoder 34*a*,34*b*.

Figure 5:
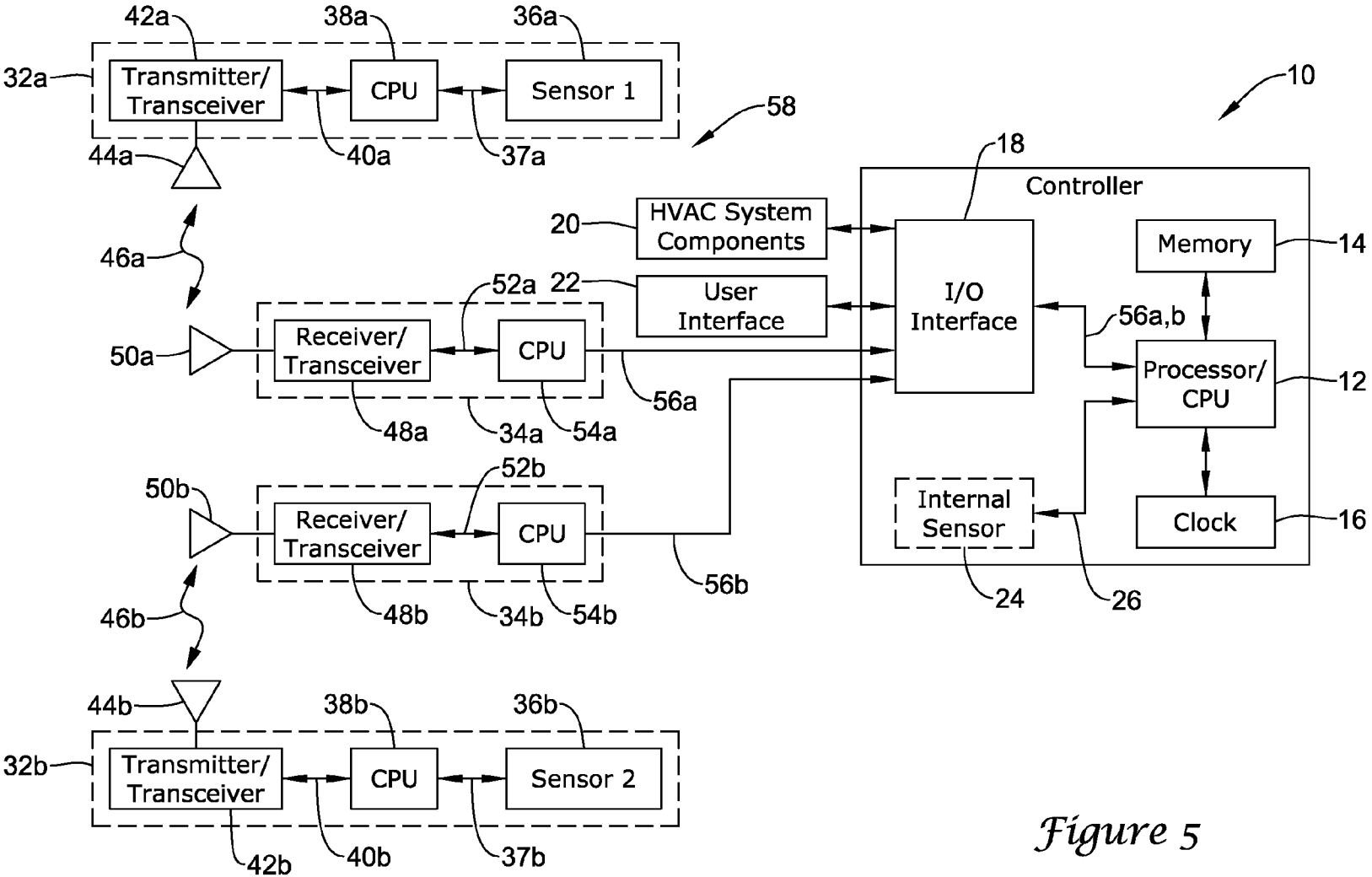
FIG. 5 is a diagrammatic view showing another illustrative system for controlling a HVAC controller using signals received from multiple wireless devices each in communication with an associated decoder.
Figure 6:
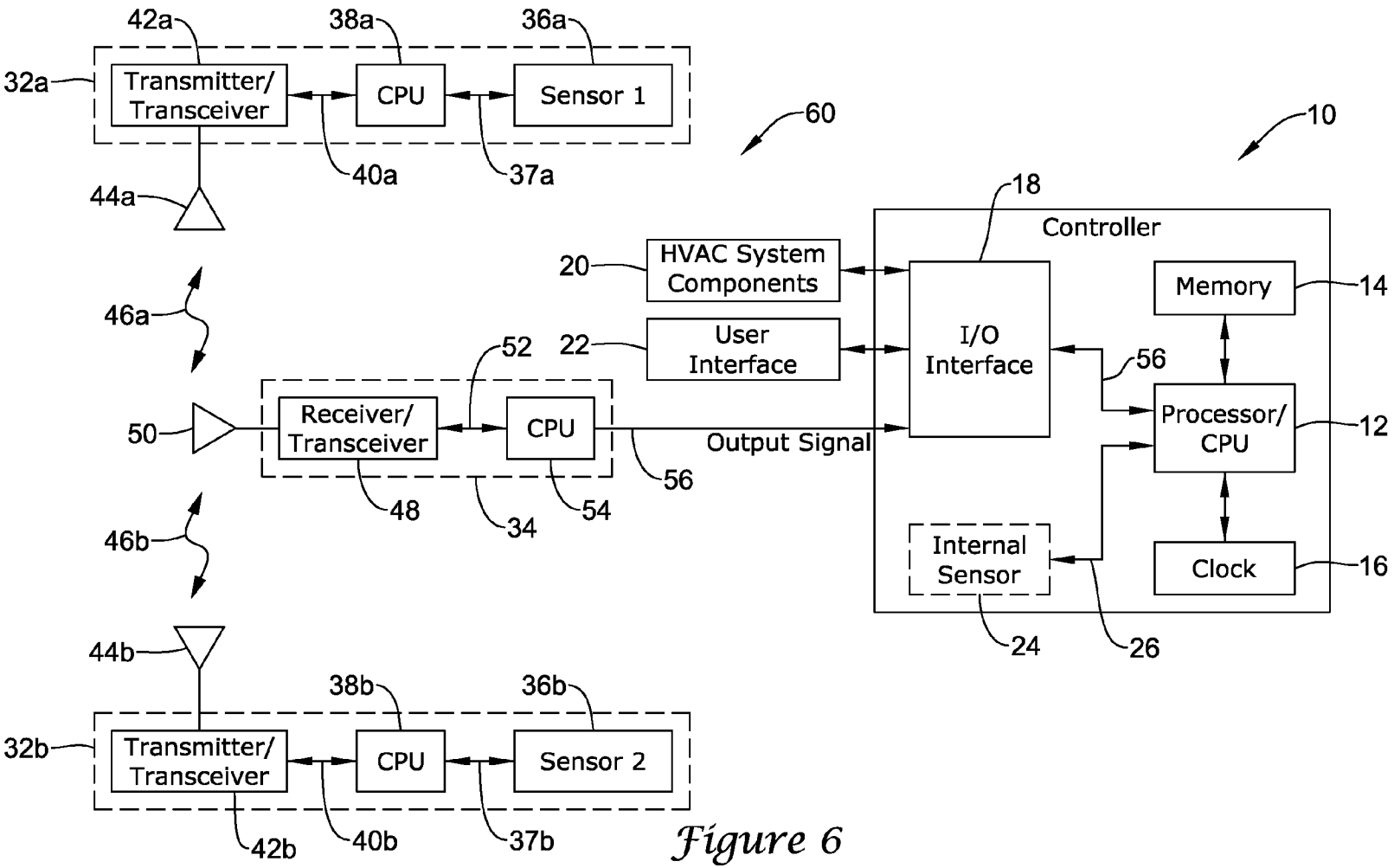
FIG. 6 is a diagrammatic view showing another illustrative system for controlling a HVAC controller using signals received from multiple wireless devices in communication with a single decoder.

Although each wireless device 32*a*,32*b* is shown in FIG. 5 as having an associated decoder 34*a*,34*b* that receives and converts the corresponding wireless signals 46 into a format that is compatible with a corresponding remote sensor input of the controller 10, it should be understood that a single decoder 34 capable of receiving signals from multiple wireless devices 32*a*,32 may be employed. In one illustrative system 60 depicted in FIG. 6, for example, a single decoder 34 can be configured to receive wireless signals 46*a*,46*b* from a pair of wireless sensors 32*a*,32*b*. As with the embodiment of FIG. 5, any interference between the wireless signals 46*a*,46*b* transmitted by each wireless sensor 32*a*,32*b* can be reduced or eliminated by sending the signals 46*a*,46*b* at discrete time intervals and/or by assigning different frequencies or bands to each device 32*a*,32*b*.

Figure 7:
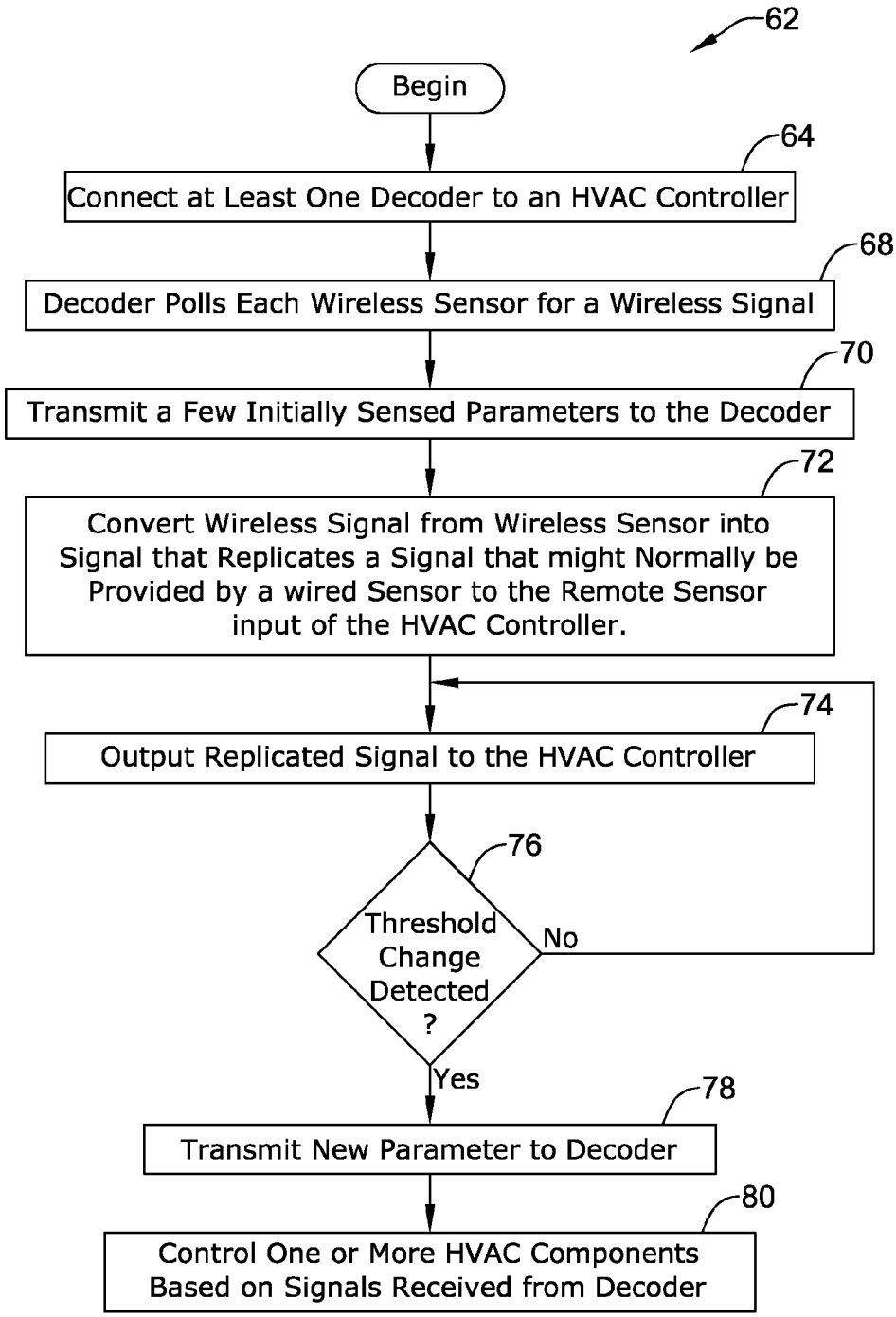
FIG. 7 is a flow chart showing an illustrative method for connecting one or more wireless remote sensors to a controller.

FIG. 7 is a flow chart showing an illustrative method 62 for connecting one or more wireless remote sensors to an HVAC controller. The method 62 may begin generally at block 64 with the connection of at least one decoder to a HVAC controller. Block 64 may represent, for example, the step of plugging in or otherwise connecting a decoder to a remote sensor input of the HVAC controller. The decoder can be equipped with an receiver (or transceiver) and a processor or other circuitry that can be configured to receive and process wireless signals transmitted from one or more wireless sensors in which the user desires to connect to the HVAC controller. In one example, the decoder can be configured to receive and process wireless signals from a wireless temperature sensor that can be used by the HVAC controller to control one or more components of an HVAC system based on the sensed temperature. The connection of the decoder to the HVAC controller may replace what would conventionally be a wired connection between a wired sensor and the HVAC controller.

In one illustrative embodiment, once connected, the decoder can be configured to poll each wireless sensor for a wireless signal, as indicated generally at block 68. At startup, the wireless sensor can be configured to send a few initially sensed parameters to the decoder, as indicated generally at block 70. In those embodiments where the wireless sensor is a temperature sensor, the sensor can be configured to provide an initial number of temperature measurements signals for a predetermined period of time (e.g. every 10 seconds for 5 minutes). If no such signal is available, the decoder can provide the controller with the last sensed parameter transmitted by the temperature sensor, or if no such signal is available, a pre-programmed value stored within the decoder. If desired, the decoder can be configured to offset or otherwise calibrate the temperature measurements received from the temperature sensor by a desired amount to account for any differences in temperature between the location of the wireless temperature sensor and the HVAC controller and/or to account for any other calibration factors. Alternatively, or in addition, such an offset or calibration may be applied by the HVAC controller, if desired.

The wireless signals received from each wireless sensor can be converted into a signal by the decoder that mimics or replicates a signal that would normally be provided by a wired remote sensor to the remote sensor input of the HVAC controller, as indicated generally at block 72. The conversion of the wireless signal can be accomplished by, for example, using a look-up table, a conversion map, an equation, a discrete circuit, and/or any other suitable method to produce a signal response that mimics the response that would normally be provided by a wired remote sensor.

The output signal provided by the decoder can be used by the HVAC controller in lieu of the signal that would normally be provided by a wired remote sensor, as indicated generally at block 74. Since the decoder output signal mimics the temperature or other signals normally provided by a wired remote sensor, the user may be allowed to connect the wireless sensor to the controller without having to reconfigure the existing wiring scheme or to reprogram the controller to accept the new wireless remote sensor.

In some cases, once an initial number of signals have been received by the decoder and have been converted for use by the controller, the wireless sensor can be configured to revert to a second mode of operation whereby wireless signals are provided to the decoder only in response to a change sensed by the wireless sensor, as indicated generally at blocks 76 and 78. When a wireless temperature sensor is employed, for example, the wireless sensor can be configured to transmit a temperature measurement signal to the decoder only in response to a sensed temperature change that is greater than 0.125° F., 0.25° F., 0.5° F., or some other threshold amount. The transmission of signals to the decoder only upon a sensed change in temperature may help reduce transmitter energy usage, which can prolong battery life when a battery is the power source, and may reduce interference with other wireless devices operating in the same general area. If the sensed temperature does not vary by the threshold amount within a predefined time period (e.g. 30 minutes), the transmission from the wireless temperature sensor can occur irrespective of any sensed temperature difference to provide confirmation to the controller that the sensor is still functioning properly. As indicated generally by block 80, the HVAC controller may control one or more HVAC system components based at least in part on the signals received from the decoder.

Having thus described several embodiments, those of skill in the art will readily appreciate that other embodiments may be made and used which fall within the scope of the claims attached hereto. It will be understood that this disclosure is, in many respects, only illustrative. Changes can be made with respect to various elements described herein without exceeding the scope of the invention.

What is claimed is:

1. A controller for controlling an HVAC system, comprising:

an HVAC controller configured to selectively activate and deactivate one or more HVAC components of an HVAC system to control the comfort level of at least a portion of a building, the HVAC controller having a remote sensor input, wherein the HVAC controller is configured to expect the remote sensor input to be connected to a remote sensor having an expected sensor output characteristic;

a wireless sensor device including a wireless transmitter and at least one remote sensor for sensing one or more parameters remote from the HVAC controller and for wirelessly transmitting a sensor signal that is representative of the one or more sensed parameters, wherein the wirelessly transmitted sensor signal does not have the expected sensor output characteristic; and a decoder connected to the remote sensor input of the HVAC controller, the decoder including:

a wireless receiver configured to receive the wirelessly transmitted sensor signal;

a user interface that allows a user to select a preset output characteristic from two or more different preset output characteristics of the decoder, resulting in a selected preset output characteristic; and wherein the decoder is configured to convert the received wirelessly transmitted sensor signal into an output signal that has the selected preset output characteristic so as to convey a value that is representative of the one or more sensed parameters and is compatible with the expected sensor characteristic of the remote sensor input of the HVAC controller.

2. The controller of claim 1, wherein the at least one wireless sensor device includes a wireless temperature sensor configured to sense air temperature at a location remote from the HVAC controller.

3. The controller of claim 1, wherein the selected preset output characteristic includes an analog output signal that is representative of the one or more sensed parameters.

4. The controller of claim 3, wherein the analog output signal is an analog current signal within the range of about 4-20mA.

5. The controller of claim 3, wherein the analog output signal is an analog voltage signal.

6. The controller of claim 1, wherein the two or more different preset output characteristics correspond to resistance values that fall in two or more different resistance ranges.

7. The controller of claim 6, wherein a first one of the two or more different preset output characteristics corresponds to an output from a 20K ohm thermistor, and a second one of the two or more different preset output characteristics corresponds to an output from a 10K ohm thermistor.

8. The controller of claim 1, wherein the wireless transmitter and wireless receiver each operate in the radio frequency range.

9. The controller of claim 1, wherein a first one of the two or more different preset output characteristics corresponds to a first impedance range, and a second one of the two or more different preset output characteristics corresponds to a second impedance range.

10. The controller of claim 1, wherein the decoder is in radio communication with multiple wireless sensor devices.

11. The controller of claim 1, wherein a first one of the two or more different preset output characteristics corresponds to a frequency characteristic, and a second one of the two or more different preset output characteristics corresponds to an impedance characteristic.

12. A controller for controlling an HVAC system, comprising:

an HVAC controller having a remote sensor input, the HVAC controller expecting the remote sensor input to be connected to a thermistor having an expected sensor output characteristic, the HVAC controller configured to control one or more HVAC components of an HVAC system based, at least in part, on the remote sensor input;

a wireless temperature sensor including a wireless transmitter, and further including a thermistor for use in sensing a temperature at a location remote from the HVAC controller; and a decoder connected to the remote sensor input of the HVAC controller, the decoder including a wireless receiver configured to receive a wireless signal transmitted by the wireless transmitter of the wireless temperature sensor, the decoder having a circuit with two or more different selectable preprogrammed output characteristics that each mimic a resistance of a corresponding one of two or more different thermistors, whereby a user can select a selected output characteristic from the two or more different preprogrammed output characteristics the decoder is configured to convert the received wireless signal into an analog signal that has the selected output characteristic and provides the analog signal to the remote sensor input of the HVAC controller.

13. The controller of claim 12, wherein the HVAC controller is configured to control one or more HVAC components based at least in part on the analog signal presented by the decoder.

14. The controller of claim 12, wherein the decoder can be used in conjunction with each of two or more remote sensor inputs by simply selecting an appropriate one of the two or more different preprogrammed output characteristics.

15. The controller of claim 14, wherein one of the two or more different thermistors corresponds to a 10 kΩ thermistor.

16. The controller of claim 14, wherein one of the two or more different thermistors corresponds to a 20 kΩ thermistor.

17. The controller of claim 14, wherein one of the two or more different thermistors corresponds to a 30 kΩ thermistor.

18. A method, comprising:

providing a controller having a remote sensor input, the controller expecting the remote sensor input to be connected to a remote sensor with an expected sensor characteristic, the controller configured to control one or more components;

providing a decoder having a receiver configured to receive a wireless signal from a remote wireless sensor device, the decoder further having an output for providing an output signal to the remote sensor input of the controller;

receiving at the decoder a wireless signal transmitted from the remote wireless sensor device, wherein the wireless signal represents at least one sensed parameter at the remote wireless sensor device;

selecting between one of two or more different preset output characteristics of the decoder, resulting in a selected output characteristic, wherein the selected output characteristic is compatible with the expected sensor characteristic of the remote sensor input of the controller;

transforming the received wireless signal into the output signal of the decoder, wherein the output signal of the decoder is representative of the at least one sensed parameter and is compatible with the selected output characteristic;

presenting the output signal of the decoder to the remote sensor input of the controller; and controlling one or more of the components based on the output signal presented to the remote sensor input of the controller.

19. The method of claim 18, wherein the expected sensor characteristic corresponds to a wired sensor.

20. The method of claim 19, wherein the wired sensor is a thermistor.

* * * * *